US006422915B1

(12) United States Patent
Chen

(10) Patent No.: US 6,422,915 B1
(45) Date of Patent: Jul. 23, 2002

(54) DYNAMIC COLLAPSIBLE REVOLVING TOY

(76) Inventor: Kun-Yueh Chen, No. 18, Alley 7, Lane 39, Kuo-Tai Street, Panchiao City, Taipei Hsien (TW)

( * ) Notice: Subject to any disclaimer, the term of this patent is extended or adjusted under 35 U.S.C. 154(b) by 0 days.

(21) Appl. No.: 09/799,705

(22) Filed: Mar. 7, 2001

(51) Int. Cl.[7] ..... A63H 1/24; A63H 1/28

(52) U.S. Cl. ..... 446/242; 446/397; 446/175; 40/610; 74/89.22; 403/109.7

(58) Field of Search ..... 446/236, 242, 446/265, 397, 404, 484, 489, 175; 40/610, 470, 538, 540, 463, 466; 74/89.22; 403/109.7, 109.1

(56) References Cited

U.S. PATENT DOCUMENTS 1,495,645 A * 5/1924 Pucek ..... 446/265
1,527,596 A * 2/1925 MacCartney ..... 446/242
2,874,496 A * 2/1959 Rakes ..... 40/466
6,247,991 B1 * 6/2001 Chen ..... 40/610

* cited by examiner

*Primary Examiner*—Jacob K. Ackun
*Assistant Examiner*—Bena B. Miller
(74) *Attorney, Agent, or Firm*—Rabin & Berdo

(57) ABSTRACT

A dynamic collapsible and revolving toy includes a base with a gear seat fixedly disposed inside. A gear plate mounted on the gear seat is driven to rotate by a gearbox with a power outputting gear through engagements of a transmission gear, a reduction gear and an internal gear. There are an interior tube set and an exterior tube set disposed above the gear plate and protruded out the base. The innermost tube of the exterior tube set is connected to the innermost tube of the interior tube set and the outermost tube of the exterior tube set is mounted on the gear plate. Further a retractable strip coiled on the ring slot of the gear plate is connected to the innermost tube so that the interior tube set and the exterior tube set can rotate upon the gear plate. A plurality of collars are mounted outside the exterior tube set for hanging decorative articles. A control circuit inside the gear seat makes the gearbox capable of providing the clockwise or counter-clockwise and accelerated or decelerated rotation. When a switch located on the base is pushed, a built-in IC program of the control circuit will then control the gearbox to output rotating power for extending/retracting the interior tube set, exterior tube set and the collar set from/to the base.

1 Claim, 3 Drawing Sheets

DYNAMIC COLLAPSIBLE REVOLVING TOY

CROSS-REFERENCE TO RELATED APPLICATION

This application makes reference to and incorporates with U.S. patent application Ser. No. 09/488,523, filed on Jan. 21, 2000.

BACKGROUND OF THE INVENTION

1. Field of Invention

The present invention relates in general to a dynamic collapsible revolving toy, and more particularly to one that is easy in operation and assembly, and is economical and competitive in market, including a base, an interior tube set and an exterior tube set. Inside the base, a gear plate rotatably disposed on a gear seat is combined to the interior tube set which connects with the exterior tube set. The gear plate is driven alternatively to rotate clockwise or counter-clockwise by a gearbox with a power outputting gear through engagements of a central transmission gear, a reduction gear and an internal gear. On the other hand, a strip coiled in a ring slot of the gear plate is connected to the interior tube set so that the tubes of the interior tube set can extends or retracts together with the tubes of the exterior tube set having a plurality of collars disposed outside.

2. Description of Related Art

Frequent exchanges of culture and folk custom happen between countries along with the improvement of technology in transportation. Many festivals and occasions have become common holidays to be celebrated by many countries, such as Christmas, Valentine's Day and Mother's Day, etc. For celebration, various toys and gifts would be found in the market, but most of them are static displaying for viewing enjoyment. We see very little dynamic toys and gifts. Applicant therefore filed an application of U.S. patent application Ser. No. 09/488,523 on Jan. 21, 2000, entitled "Dynamic collapsible rotating toy" as attached. It disclosed a toy having the structure including an interior sleeve set 20 and an exterior sleeve set 30 that are installed at the center inside a base 10. The interior sleeve set 20 has a winding strip and driven by an extension/retraction driving motor 50. The exterior sleeve set 30 covers outside of the interior sleeve set 20, of which innermost sleeve 31 is linked to the innermost sleeve 21 of the interior sleeve set 20 so that can execute extending and retracting functions when driven by the motor 50. On the upper rim of each sleeve of the exterior sleeve set 30 are inserted a decorative article (such as Christmas tree leaves) 32 fitted to the toy (such as Christmas tree). The outermost sleeve 33 links with a gear 34 which is toothed with and driven by a rotation driving motor 60 through a reduction gear 61. When a user turns on the power switch 13 on one side of the base 10, the extension/retraction driving motor 50 is started to drive a winding strip 40 to push the interior and exterior sleeve sets 20 and 30 out from the base 10 so that they can extrude right above the base 10. The gear 34 then on the base of the exterior sleeve set 30 touches and activates a first micro switch 70 located on one side of the sleeve set, thereby activating the rotation driving motor 60. Therefore, on one hand, it controls the reduction gear 61 to drive the exterior sleeve set 30 to rotate slowly, while on the other hand, it drives the control circuit installed inside the base 10 to play melodious music and flash the LED lamps 36 hanging on the decorative article 32. When the user turns on another operating switch 14, it will turn off the music and LED 36, and drive the extension/retraction driving motor 50 to turn in a reverse direction, then the extended interior and exterior sleeve sets 20 and 30 will be retracted into the base 10, until after the gear 34 on the base of the exterior sleeve set 30 touches another second micro switch 71, it will automatically cut off power and restore to its idle status. Though the operation of the above-mentioned toy is quite easy and convenient and the movement is fun and smooth, the structure is somewhat complicated when manufacturing. Especially, it uses two driving motors that increase the cost. It should be enhanced to be more competitive.

SUMMARY OF THE INVENTION

In view of the above, it is an object of the present invention to provide an improved dynamic collapsible revolving toy. Applicant has dedicated in the research, based on many years of rich experiences in R&D and in producing various toys and gifts. After repeating processes in drawing, production test and revising, it has finally come up with a "dynamic, collapsible, revolving toy" that is full of fun and amusement, that is economical and competitive in market.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become fully understood from the detailed description given hereinbelow illustration only, and thus are not limitative of the present invention, and wherein.

DETAILED DESCRIPTION OF THE INVENTION

Figure 4:
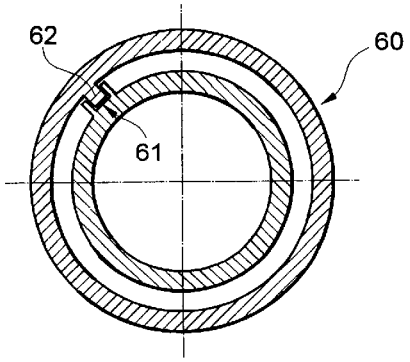
FIG. 4 is a section view of the line B—B according to FIG. 1.

Referring to FIGS. 1 to 4, the structure of the present invention includes a base 10 which a gear seat 20 is fixedly disposed inside. A gearbox 30 with a power outputting gear 31 located above the gear seat 20 is disposed below the gear seat 20. The power outputting gear 31 engages to a central transmission gear 32 which three reduction gears 33 are engaged separately. Further there is an internal gear 34 engaged all the reduction gears and connected to a gear plate 40. The gear plate 40 with a ring slot 41 is rotatably mounted on the gear seat 20; therefore, under the engagements of gears 31, 32, 33 and 34 covered by the gear plate 40, the gear plate 40 can be driven to rotate by the gearbox 30. Furthermore, an interior tube set 50 and an exterior tube set 60 are disposed above the gear plate 40 and protruded out the base 10. The interior tube set 50 is combined by a plurality of hollow tubes, such as three tubes in present embodiment. Similarly, the exterior tube set 60 is combined by three hollow tubes to cover outside the interior tube set 50. The connection between the tubes of the exterior tube set 60 is shown in FIG. 4 that can lead the tubes to be positioned and rotate together by the engagement of an extrusion 62 with a groove 61. The innermost tube 63 of the exterior tube set 60 is connected to the innermost tube 51 of the interior tube set 50. The outermost tube 64 of the exterior tube set 60 is then fixedly mounted on the gear plate 40. There is a flexible retractable strip 42 coiled on the ring slot 42 of the gear plate 40. The free end of the strip 42 connects to distal end of the innermost tube 51 through the hollow tubes of the interior tube set 50. Further a collar set 70, such as having eight collars in present embodiment, are disposed outside the exterior tube set 60. The uppermost collar 71 of the collar set 70 is connected to the innermost tube 63 and the lowermost collar 72 is located on the gear plate 40. It provides isometric connection between two collars by at least two ropes, that is, 180 degrees for two-roped connection between two ropes and 120 degrees for three-roped connection. As such, the rotation of the gear plate 40 can make the interior tube set 50, the exterior tube set 60 and the collar set 70 have a horizontal rotation and further lead the strip 42 to make them have a vertical extension/retraction from/to the base 10 according to the rotating orientation of the power outputting gear 31. A suitable decorative article 74, such as Christmas tree leaves for a collapsible Christmas tree, can be decorated on the collars of the collar set 70. Finally, a battery room 11 and a control circuit 12 are disposed inside the base. The control circuit 12 is connected to the gearbox 30 and the battery room 11 with batteries so that when pushing a switch 13 it can start the whole activation of the toy. The control circuit 12 is designed with different IC program depending on the topic, variety or purpose of the toy, capable of controlling the power outputting gear 31 of the gearbox 30 with clockwise/counter-clockwise and faster/slower rotation.

Figure 1:
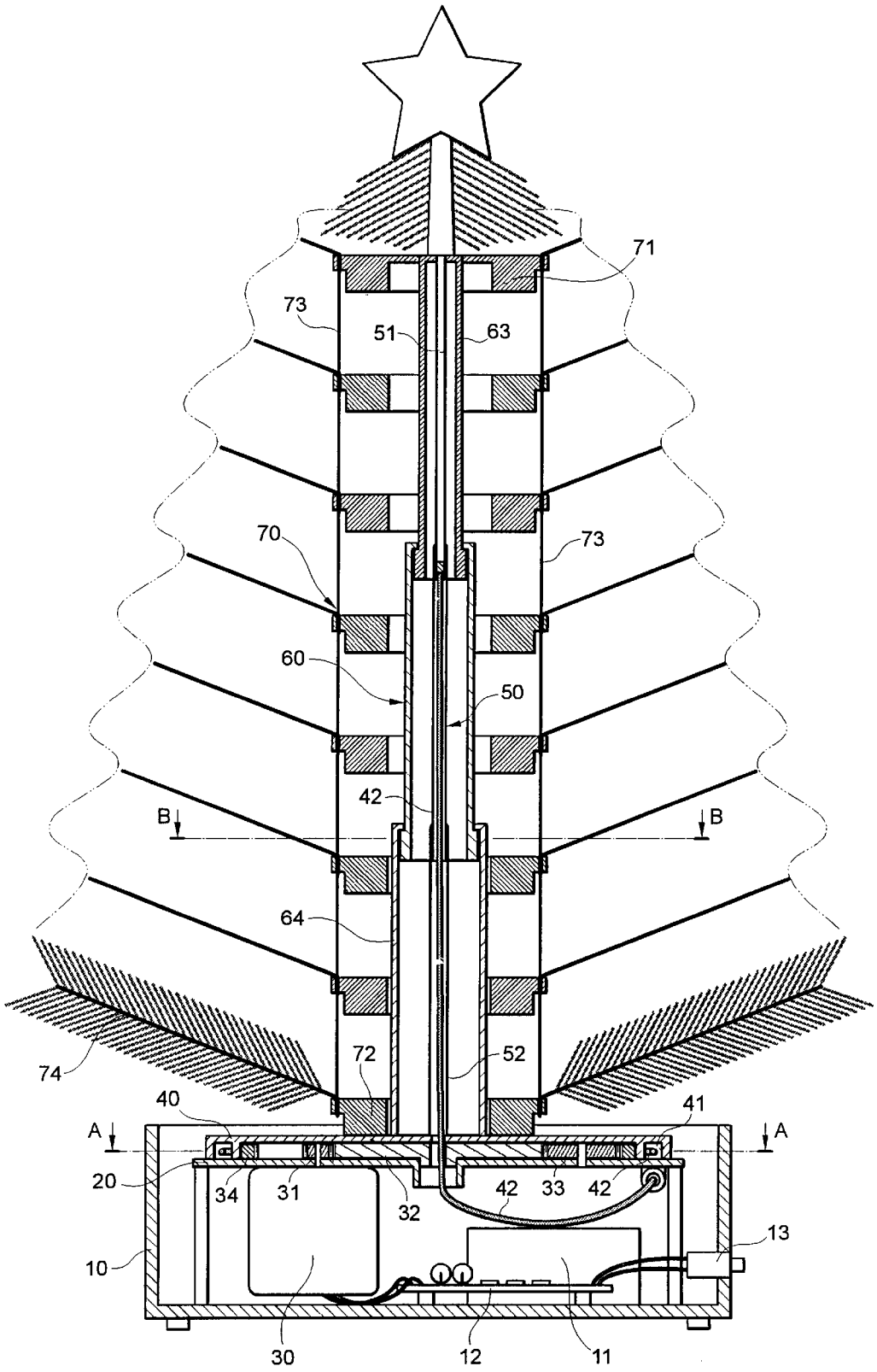
FIG. 1 shows the present invention in operation.
Figure 2:
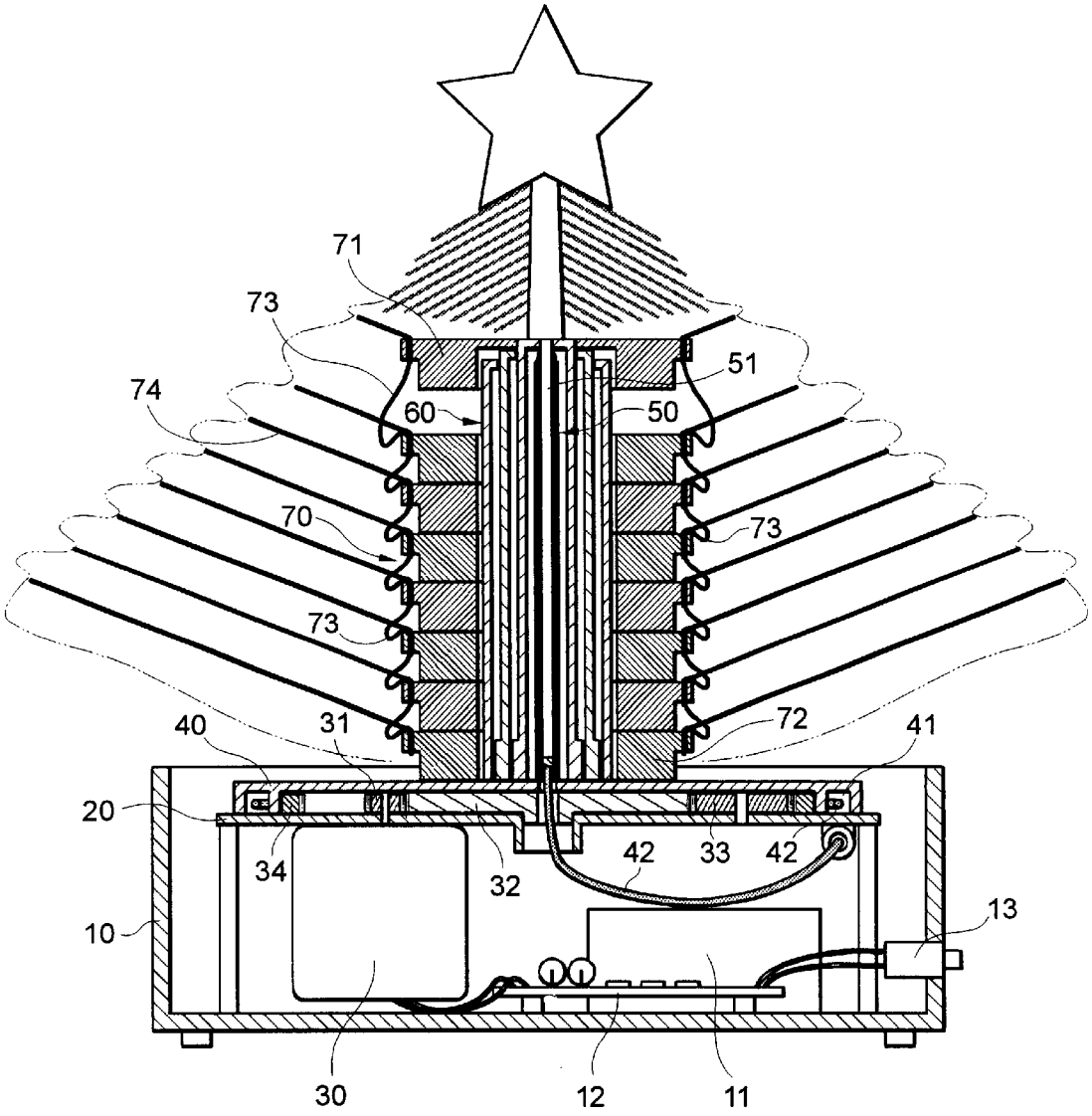
FIG. 2 shows the present invention in idle.
Figure 3:
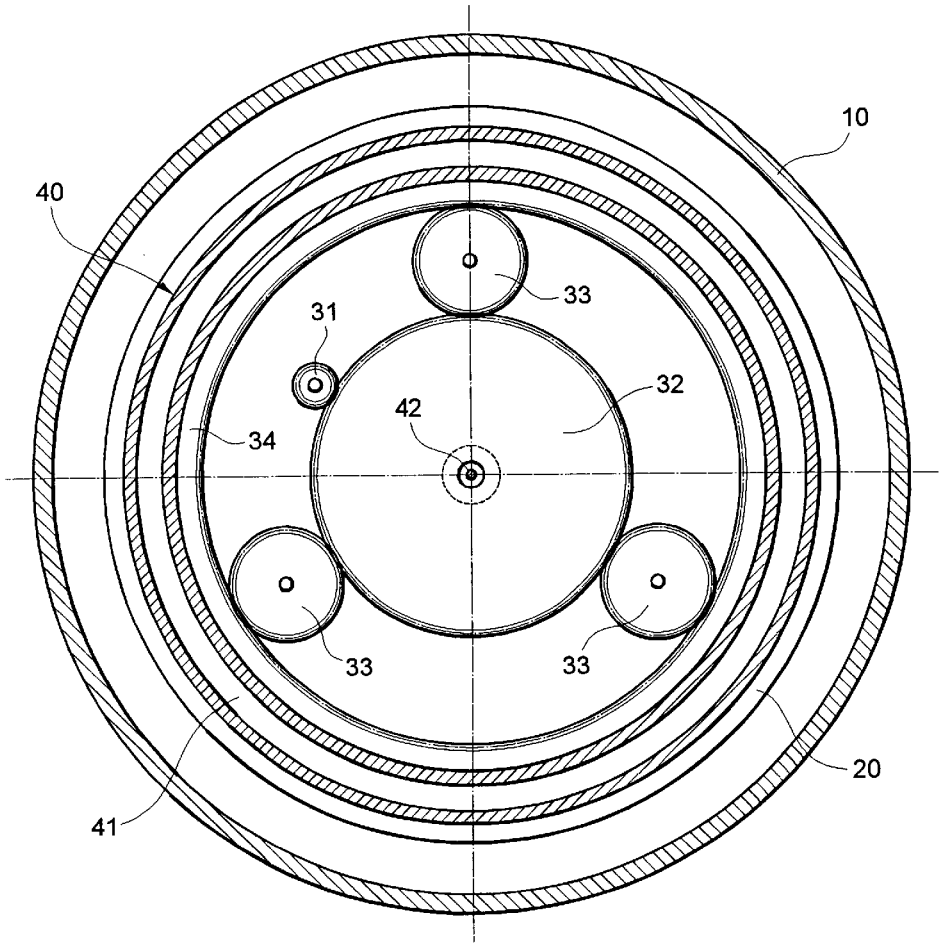
FIG. 3 is a section view of the line A—A according to FIG. 1.

According to the above-mentioned structure, the present invention is idle as shown in FIG. 2. The interior tube set 50, the exterior tube set 60 and the collar set 70 are retracted together. It shows the toy is a small and not grow-up Christmas tree. When the switch 13 is pushed, the control circuit 12 actuates the power outputting gear 31 of the gearbox 30 rotating. The sequential engagements of the power outputting gear 31, the central transmission gear 32, the reduction gear 33 and the internal gear 34 make the gear plate 40 connected with the internal gear 34 rotate. There are two actions happened while the gear plate 40 is rotating. One is the exterior tube set 60 in connection to the gear plate 40 is rotated by the engagement of the groove 61 and the extrusion 62. The other is the strip 42 coiled on the ring slot 41 is pulled out to drive the connections of the innermost tube 51, 63 and collar 71 raising up. Such that the tubes of the interior tube set 50 and the exterior tube set 60 and further the collars of the collar set 70 are raised up one by one until they are fully extended as shown in FIG. 1. During the operation, one can see a small Christmas growing up continuously and thereafter even still rotating until the switch 13 is again pushed. The control circuit 12 can also include music function to play melody and lamps are added on the leaves to have celebrating and amusing pleasure. When the switch 13 is again pushed, the control circuit 12 actuates the power outputting gear 31 of the gearbox 30 rotating inversely. Similarly, due to the engagements of the power outputting gear 31, the central transmission gear 32, the reduction gear 33 and the internal gear 34, the gear plate 40 is rotated inversely. Such that, the strip 42 is wound to retract all interior tube set 50, exterior tube set 60 and collar set 70. The toy tree is then again a small and not grow-up one. It can depend on the IC program design of the control circuit 12 to stop the rotation of the tree or still have rotation before the switch 13 is once again pushed.

Furthermore, without changing the basic structure, the appearance of the invention can be properly modified or revised to represent different themes. For example, the collar set 70 can be formed as a multi-layered cake, and the base 10 can be as a cake box, then the invention can be a birthday present. Another, the collar set 30 can be formed to show a Paris Eiffel Tower, then the invention will become a dynamic decorative item presenting multiple themes with excellent application. Summing up, the structure of the present invention is easy and can use only one motor inside the gearbox 30. That is, it is easy for assembly and is more competitive and economical in market.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A dynamic collapsible revolving toy comprising a base, inside the base a gear seat being fixedly disposed, a gearbox with a power outputting gear being located on the gear seat, a central transmission gear being engaged to the power outputting gear, a plurality of reduction gears being engaged to the central transmission gear, an internal gear being engaged to the reduction gears and a gear plate being connected to the internal gear, the gear plate with a ring slot being rotatably mounted on the gear seat so that it is driven to rotate by the actuation of the gearbox; an interior tube set and an exterior tube set both with a plurality of hollow tubes being disposed above the gear plate and protruded out the base, the tubes of the exterior tube set being positioned and rotated together by the engagement of an extrusion engaged with a groove, a innermost tube of the exterior tube set being connected to a innermost tube of the interior tube set, a outermost tube of the exterior tube set being mounted on the gear plate; a retractable strip coiled on the ring slot of the gear plate being connected to the innermost tube; a collar set with a plurality of collars being disposed outside the exterior tube set, a uppermost collar of the collar set being connected to the innermost tube and a lowermost collar of the collar set being located on the gear plate, a plurality of ropes being connected between two collars and a plurality of articles being decorated on the collars; a battery room and a control circuit being disposed inside the base, the control circuit being connected to the gearbox and the battery room with batteries so that when pushing a switch it can start the whole activation of the toy, the control circuit controlling the power outputting gear to drive the gear plate has clockwise/counter-clockwise and faster/slower rotation, thereby making the interior tube set, the exterior tube set and the collar set have a horizontal rotation and further leading by the strip having a vertical extension/retraction from/to the base according to the rotating orientation.

* * * * *